US010092903B2

(12) United States Patent
Prins et al.

(10) Patent No.: US 10,092,903 B2
(45) Date of Patent: Oct. 9, 2018

(54) MULTI-COMPARTMENT DEVICE WITH MAGNETIC PARTICLES

(75) Inventors: Menno Willem Jose Prins, Eindhoven (NL); Joost Hubert Maas, Eindhoven (NL); Albert Hendrik Jan Immink, Eindhoven (NL); Dirkjan Bernhard Van Dam, Eindhoven (NL); Maatje Koets, Eindhoven (NL); Michel J. M. Bruyninckx, Arendonk (BE); Thea Van Der Wijk, Bunnik (NL); Marius Iosif Boamfa, Eindhoven (NL); Remco Den Dulk, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1163 days.

(21) Appl. No.: 12/809,208

(22) PCT Filed: Dec. 16, 2008

(86) PCT No.: PCT/IB2008/055330

§ 371 (c)(1),
(2), (4) Date: Jun. 18, 2010

(87) PCT Pub. No.: WO2009/083862

PCT Pub. Date: Jul. 9, 2009

(65) Prior Publication Data

US 2010/0273142 A1 Oct. 28, 2010

(30) Foreign Application Priority Data

Dec. 20, 2007 (EP) ..... 07123830

(51) Int. Cl.
*B01L 3/00* (2006.01)

(52) U.S. Cl.
CPC . *B01L 3/502738* (2013.01); *B01L 2200/0647* (2013.01); *B01L 2300/089* (2013.01);
(Continued)

(58) Field of Classification Search
CPC ..... B01L 3/502738; B01L 2200/0647; B01L 2300/089; B01L 2300/161; B01L 2400/043; B01L 2400/0688; B01L 2400/088
(Continued)

(56) References Cited

U.S. PATENT DOCUMENTS 4,777,145 A 10/1988 Luotola
5,279,936 A 1/1994 Vorpahl
(Continued)

FOREIGN PATENT DOCUMENTS

DE 102005029809 A1 12/2006
EP 1707965 A1 10/2006
(Continued)

OTHER PUBLICATIONS

Pamme, Nicole "Magnetism and Microfluidics" Lab on a Chip, vol. 6, pp. 24-38, 2006.
(Continued)

*Primary Examiner* — Melanie Yu Brown

(57) ABSTRACT

The present invention discloses microfluidic devices with a valve-like structure (3), through which magnetic particles can be transported with minimal transport of fluids. This allows sequential processing of the magnetic particles.

11 Claims, 3 Drawing Sheets

(52) U.S. Cl.
CPC ... *B01L 2300/161* (2013.01); *B01L 2400/043* (2013.01); *B01L 2400/0688* (2013.01); *B01L 2400/088* (2013.01)

(58) Field of Classification Search
USPC ..... 436/526
See application file for complete search history.

(56) References Cited

U.S. PATENT DOCUMENTS

| | | | | |
|---|---|---|---|---|
| 6,175,109 | B1 | 1/2001 | Setbacken | |
| 6,867,412 | B2 | 3/2005 | Patzwald | |
| 7,088,650 | B1 | 8/2006 | Worthington | |
| 7,251,210 | B2 | 7/2007 | Coombs | |
| 7,329,535 | B2 | 2/2008 | Oh | |
| 2002/0166800 | A1 | 11/2002 | Prentiss | |
| 2003/0012483 | A1* | 1/2003 | Ticknor | B01F 13/0076 385/16 |
| 2003/0040011 | A1* | 2/2003 | Barth et al. | 435/7.1 |
| 2003/0092172 | A1 | 5/2003 | Oh | |
| 2003/0187237 | A1* | 10/2003 | Chan | C12Q 1/6869 536/22.1 |
| 2004/0072278 | A1* | 4/2004 | Chou et al. | 435/29 |
| 2004/0118758 | A1 | 6/2004 | Gordon-Ingram | |
| 2005/0009004 | A1* | 1/2005 | Xu et al. | 435/4 |
| 2005/0244308 | A1 | 11/2005 | Tanaami | |
| 2006/0186055 | A1 | 8/2006 | Kusumoto | |
| 2006/0278287 | A1 | 12/2006 | Fielden | |
| 2007/0170059 | A1 | 7/2007 | Lee | |
| 2008/0031787 | A1 | 2/2008 | Yu | |
| 2008/0160622 | A1* | 7/2008 | Su et al. | 436/86 |
| 2008/0160634 | A1* | 7/2008 | Su et al. | 436/501 |
| 2008/0226500 | A1 | 9/2008 | Shikida | |
| 2009/0148933 | A1* | 6/2009 | Battrell | B01F 11/0071 435/287.2 |
| 2009/0220932 | A1 | 9/2009 | Ingber | |
| 2010/0291666 | A1* | 11/2010 | Collier | B01L 3/502715 435/287.2 |

FOREIGN PATENT DOCUMENTS

| | | | |
|---|---|---|---|
| JP | 2005308668 | A | 11/2005 |
| WO | 199426414 | A1 | 11/1994 |
| WO | 2003072227 | A1 | 9/2003 |
| WO | 2007096730 | A1 | 8/2007 |
| WO | 2007110779 | A2 | 10/2007 |
| WO | 2008012724 | A2 | 1/2008 |

OTHER PUBLICATIONS

Zabow, G. et al "Guided Microfluidics by Electromagnetic Capillary Focusing", Applied Physics Letters, vol. 80, No. 8, Feb. 2002, pp. 1483-1485.

Shikida, Mitsuhiro et al "Using Wettability and Interfacial Tension to Handle Droplets of Magnetic Beads in a Micro-Chemical—Analysis System", Sensors and Actuators B, vol. 113, 2006, pp. 563-569.

Ito, Hiroshi et al "Proposal of Pumpless, Valveless, and Flowless Miniaturized Reactor using Magnetic Beads for the Portable Analysis Device", Journal of Chemical Engineering of Japan, vol. 39, No. 12, 2006, pp. 1296-1299.

* cited by examiner

MULTI-COMPARTMENT DEVICE WITH MAGNETIC PARTICLES

FIELD OF THE INVENTION

This invention relates to microfluidic systems and devices with integrated specialized valve-like structures for fluid and magnetic bead handling, as well as methods comprising the use of such devices and systems.

BACKGROUND OF THE INVENTION

Magnetic carriers are widely used in in-vitro diagnostics for target up-concentration and target extraction. Targets can be cells, cell fractions, proteins, nucleic acids, etc. The targets bind to magnetic particles, and subsequently these are separated from the fluid in which the targets were suspended. Thereafter further steps can take place, e.g. storage, biochemical processing, or detection.

For a review on microfluidic systems reference is made to "N. Pamme, magnetism and microfluidics, Lab Chip, 2006, 6, 24-38". Current systems generally rely on a multiplicity of distinct processes to manipulate fluids and magnetic beads with micro pumps and micro valves, e.g. for wash steps of the magnetic particles and for buffer replacements. Each step hereby introduces a potential for error into the overall process. These processes also draw from a large number of distinct disciplines, including chemistry, molecular biology, medicine and others. It would therefore be desirable to integrate the various processes used in diagnosis, in a single system, at a minimum cost, high reliability, and with a maximum ease of operation.

SUMMARY OF THE INVENTION

The present invention provides novel micro fluidic systems and devices with specialized valve-like structures, together with the corresponding methods for their use. These systems and devices can be used in various technical applications, such as micro-scale synthesis, detection, diagnosis and the like. A valve function for magnetic particles is provided, wherein the valve function preferentially has no side channels in the micro fluidic device, resulting in a low cost, easy to process cartridge.

The devices according to the present invention are multi-compartment devices in which magnetic carriers are transported between different compartments with minimal transport of fluids. In order to separate the magnetic carriers from the surrounding fluids, the channels of the devices may be fitted with special barrier materials, which allow the passage of magnetic particles but hinder the passage of fluids. This can be achieved by the use of a deformable material and/or by hydrophobic components or modifications in the valve-like structure. In the devices and systems according to one embodiment of the present invention, the magnetic particles are concentrated at the border of the valve-like structure by magnetic actuation and pulled through the valve-like structure by a magnetic force applied on the particles. Valve-like structures may be installed sequentially in order to enhance the separation of particles and fluid.

The devices according to the present invention may be multi-compartment devices. Furthermore, the microfluidic systems implemented in multi-compartment devices in which magnetic carriers are transported between different compartments with minimal transport of fluids according to the present invention may be conceived in such a way that fluids can be provided to one or more of the compartments independent of the transport of particles with or without the use of valve-like structures according to the present invention. Thereby, the fluids may be provided through another channel which may or may not be fitted with valve-like structures according to the present invention and may comprise further valves and channels commonly used in microfluidic systems.

Both devices a) and b) comprise: Compartment (1) with sample inlet (in) and sample outlet or vent (out), in which the sample containing cellular material comprising nucleic acids is introduced; compartment (2) in which cell lysis takes place and nucleic acids are liberated; compartment (3) in which nucleic acids are amplified, e.g. by PCR; compartment (4) in which nucleic acids are detected, e.g. by antibody capture.

Device b) additionally comprises valve-like structures (represented by interrupted lines) according to the present invention, by which the compartments are separated. Compartments (2) and (3) further comprise sub-compartments in which magnetic particles can be stored prior to or after use. Note that the presence of valve-like structures at the entry of the different sub-compartments is optional in the present invention.

DETAILED DESCRIPTION OF EMBODIMENTS

In one embodiment of the present invention a method for transferring magnetic particles from a fluidic sample through a valve-like structure is provided, comprising the steps:

(a) providing a device comprising at least two compartments connected by a valve-like structure wherein the valve-like structure may allow the passage of said magnetic particles upon magnetic actuation and wherein the valve-like structure prevents the mixing of the two fluids in the absence of a magnetic force, (b) filling a first of the at least two compartments with a fluidic sample comprising magnetic particles, (c) applying a magnetic force that drags said magnetic particles across the valve-like structure transferring it from a first of the at least two compartments to a second compartment.

In a preferred embodiment the valve-like structure comprises a visco-elastic medium, wherein the visco-elastic medium is selected from a gas, a fluid, a deformable solid or a combination thereof.

In another preferred embodiment the valve-like structure comprises a hydrophobic barrier and the magnetic force drives the particles across the hydrophobic barrier.

Figure 2:
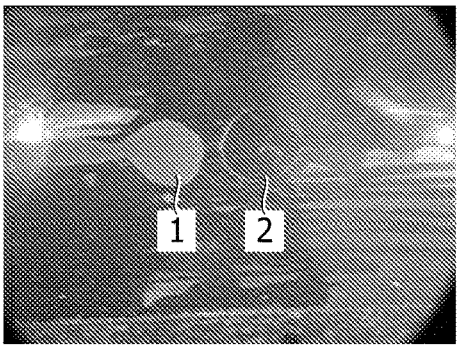
FIG. 2 A planar micro fluidic device with virtual channels and compartments. Fluid flow can be observed via virtual channels formed by local hydrophilisation of both glass substrates. Virtual compartment 1 is filled with a suspension of magnetic beads (which gives the fluid a brown coloration, so that the location of the particles can easily be monitored in this experiment) and virtual compartment 2 is filled with water. The two compartments are separated by a hydrophobic barrier.
Figure 3:
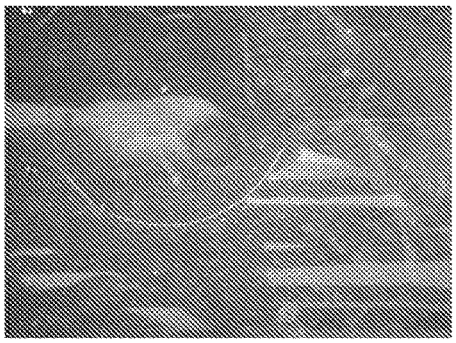
FIG. 3 A planar micro fluidic device where magnetic beads were transported from a first compartment to a second compartment by using a magnetic force. The picture shows the presence of magnetic particles inside the second compartment.

FIGS. 2 and 3 show a planar device according to the present invention comprising a hydrophobic barrier. FIG. 2 shows a suspension with magnetic particles (which gives the fluid a brown coloration) situated in compartment 1, whereas compartment 2 is filled with water. In FIG. 3, the magnetic particles have been driven particles across the hydrophobic barrier into compartment 2, whereby only a small amount of the liquid from compartment 1 has been transported together with the magnetic particles.

In another preferred embodiment the valve-like structure comprises a deformable obstruction and the magnetic force drives the particles through the deformable material.

In yet another preferred embodiment the method additionally comprises the following two steps between step (b) and (c):

concentration of the magnetic particles close to the valve-like structure by magnetic actuation, passing the particles by actuation with a magnetic force through the valve-like structure.

In yet another preferred embodiment the first compartment is filled by the sample fluid comprising the magnetic particles and the second compartment is filled by another fluid.

In yet another preferred embodiment of the method according to the present invention the fluid in the first compartment and the fluid in the second and/or further compartments are at least partially from the same source.

In a more preferred embodiment of the invention the fluid in the first compartment and the fluid in the second and/or further compartments are at least partially from the same source, wherein the source is a biological sample.

The fluid in the first compartment and the fluid in the second and/or further compartments which are at least partially from the same source may be derived from a method comprising the following steps prior to steps a) to c) of the method according to the present invention:

a fluidic sample is divided into a part I and a part II, addition of magnetic particles to part I of the divided fluid sample and transportation to said first of the at least two compartments of the provided device, conducting a pre-treatment of part II of the divided fluid sample, and transportation of part II of the divided fluid sample to said second compartment of the provided device.

These additional steps outlined above may also be performed in methods using devices which do not have the valve-like structures according to the present invention.

In a more preferred embodiment a target attached to the magnetic particles is co-transported with the magnetic particles from the first compartment to the second compartment.

In another more preferred embodiment, during the transport of particles from the first to the second compartment, the valve-like structure causes the particles to lose an essential part of the co-transported fluid of the first compartment before the particles enter the second compartment.

In another more preferred embodiment, less than 10%, preferably less than 5%, more preferably less than 1%, most preferably less than 0.1% of the fluid contained in the first compartment is transported into the second compartment together with the magnetic particles.

In yet another more preferred embodiment the ratio between the volume of the magnetic particles and the co-transported fluid of the first compartment is larger than 0.05, even more preferred 0.1 and particularly preferred 0.2 and most particularly preferred larger than 1.

Another embodiment of the present invention is a device for conducting a method according to the present invention, comprising at least two compartments connected by a valve-like structure wherein the valve-like structure wherein the valve-like structure prevents the mixing of the two fluids in the absence of a magnetic force.

A preferred embodiment of the present invention is a device for conducting a method according to the present invention, comprising at least two compartments connected by a valve-like structure wherein the valve-like structure wherein the valve-like structure allows the passage of magnetic particles upon actuation by a magnetic force.

In a preferred embodiment the valve-like structure comprises a visco-elastic medium, wherein the visco-elastic medium is selected from a gas, a fluid, a deformable solid or a combination thereof In a preferred embodiment the valve-like structure comprises a hydrophobic barrier.

In a preferred embodiment, the valve like structure comprises a capillary channel comprising at least two hydrophobic surfaces.

In a further preferred embodiment, the compartments that are separated by the hydrophobic barrier are in close proximity. In the context of this invention "in close proximity" is defined as being separated by a hydrophobic barrier with a length of less than 10 mm, preferably from 0.05 to 3 mm, more preferred from 0.5-3 mm. Without wishing to be bound by any theory, it is believed that this window of ranges, facilitates that when magnetic particles in a first fluid that are clustered together as a body, touches a second fluid, a liquid connection (also called a fluid neck) appears between the two fluids. Surprisingly, the liquid connection generates minimal cross-contamination between the two fluids, probably because (i) the magnetic particle body is situated as a plug inside the channel, and (ii) because the fluid connection appears to pinch-off very rapidly. Pinch-off refers to the phenomenon that a liquid connection breaks and retreats back from a valve area into chambers. Pinch-off preferably occurs quickly after the passage, to minimize carry-over of first fluid into the second fluid. Yet pinch-off should occur not too quickly, to allow a high transport yield of particles across the valve.

The actual transfer of the magnetic particles consists of two steps: (1) collection and concentration of the magnetic particles by magnetic actuation, in a region close to the valve-like structure; (2) the magnetic particles are pulled into the barrier region of the valve-like structure. In step (1), the shape of the fluid chamber, at the location close to the valve-like structure where magnetic particles are collected and concentrated by magnetic actuation, is preferably convex with a radius of curvature. The radius of curvature facilitates the collection and concentration of magnetic particles, generating a focused magnetic particle body that exerts a high pressure on the fluid meniscus. Preferably the diameter of curvature of the fluid chamber region where particles are collected and concentrated, is equal to or smaller than the diameter of the magnetic particle body when the body is in a disk-like shape.

In another preferred embodiment the valve-like structure comprises a deformable obstruction.

In a more preferred embodiment the visco-elastic material forms a deformable obstruction and the visco-elastic material is selected from a group comprising an oil, a gel or a deformable polymer or a combination thereof.

Another embodiment of the present invention is a system comprising a device according to the present invention and further comprising a magnetic source.

In a more preferred embodiment the magnetic source may be selected from a group comprising an electromagnet, an integrated current wire, a permanent magnet and a mechanically moving permanent magnet or electromagnet.

Another embodiment of the present invention is a system comprising a device according to the present invention and further comprising a detection unit.

Another embodiment of the present invention is the use of a device according to the present invention or a system according to the present invention for detecting biological targets.

A preferred embodiment of the present invention is the use of a device according to the present invention or a system according to the present invention in a biochemical assay selected from the group comprising binding/unbinding assay, sandwich assay, competition assay, displacement assay and enzymatic assay.

Another preferred embodiment of the present invention is the use of a device according to the present invention or a system according to the present invention in a method selected from the group comprising sensor multiplexing, label multiplexing and compartment multiplexing.

In a further embodiment the first compartment is filled by the sample fluid, potentially after a pretreatment such as filtering, and the second compartment is filled by a fluid from a separate reservoir. The second compartment is for example filled by a buffer fluid, supplied from within the cartridge of from outside of the cartridge. It is also possible that the first compartment and the second compartment are filled by the sample fluid, however after a different pretreatment.

Figure 1:
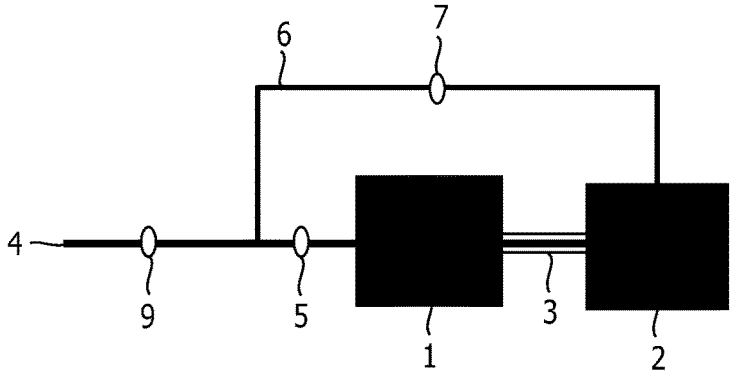
FIG. 1 Sketch of a device with compartment 1, compartment 2, a barrier channel 3, a fluid entry port 4, a pretreatment unit 5 (where e.g. reagents are added to the fluid), a parallel channel 6, a pretreatment unit 7 (wherein e.g. cells are filtered out and further reagents can be added), and common pretreatment unit 9. Compartment 2 is filled by fluid via channel 6 and pretreatment unit 7.

This is sketched in FIG. 1. Compartment 1 is filled with fluid after pretreatment 5. Compartment 2 is filled with the same fluid after pretreatment 7. This micro fluidic device may or may not comprise one or more valve-like structures according to the present invention and may or may not comprise other valves commonly used in microfluidic systems.

In a particularly preferred embodiment of the method, the device or the system according to the present invention, the valve-like structure is stably located within the device.

In another preferred embodiment of the method, the device or the system according to the present invention, multiple valve-like structures are installed sequentially between the at least two compartments. In this way, the micro fluidic devices or systems for instance can be equipped with additional wash areas which can separately be supplied with washing fluids. Each wash area therefore serves to further limit the amount of co-migrating/overflowing solvent from a first channel or chamber into a second channel or chamber.

A further embodiment of the present invention is the use of a valve-like structure, which prevents the mixing of two fluids in the absence of a magnetic force and which allows the passage of magnetic particles upon actuation by a magnetic force in a microfluidic system or device.

The following definitions are applicable for the devices, methods and systems according to the present invention.

The valve-like structure mentioned herein is a space through which, in the absence of a magnetic force, a fluid cannot pass, but through which the magnetic particles according to the present invention can be driven by a magnetic force. The valve function of the valve-like structure is effected by the visco-elastic medium comprised therein, which visco-elastic medium is selected from a gas, a fluid, a deformable solid or a combination thereof. In the case that the visco-elastic medium is a gas or a fluid, the valve-like structure comprises an additional material or feature that defines the location of the gas or fluid, e.g. a mechanical structure or region that substantially pins the gas/fluid or fluid/fluid interface, e.g. a mechanical pinning structure and/or a transition of surface energy in the device. The valve-like structure can also comprise a deformable solid, which serves as deformable visco-elastic flow obstruction.

The actual transfer of the magnetic particles consists of two steps: (1) collection and concentration of the magnetic particles by magnetic actuation, in a region close to the valve-like structure; (2) the magnetic particles are pulled into the space initially occupied by the visco-elastic material by the magnetic force applied on the particles. The fluid in which the magnetic particles were first dispersed will remain behind, which results in an extraction, a separation or a kind of self-cleaning of the magnetic particles. As a consequence of physical reality, it is of course impossible to completely avoid that an amount of the fluid is transported through the valve-like structure together with the magnetic particles. However, by careful design of the geometry of channels/compartments and valves, such co-transportation can be minimized.

Visco-elastic materials for the valve-like structure according to the present invention can for example be selected from dense (e.g. fluid or solid) to light-weighted (e.g. air), and from elastic (e.g. a plastic such as PDMS) to inelastic and viscous (e.g. a gel, or a hydrophobic oil). Materials with similar physico-chemical and mechanical properties as the above-mentioned can also be used as visco-elastic material in the present invention.

In the case of an oil or another liquid, meniscus pinning may be used in order to assure that the valve-like structure comprising the visco-elastic material is stably located within the device. Meniscus pinning may be effected by a region that substantially pins a contact line of the gas/fluid or fluid/fluid interface, e.g. a mechanical structure with varying orientation of the surface normal (e.g. an edge) and/or a transition of surface energy (e.g. from high to low surface energy, e.g. from hydrophilic to hydrophobic).

Channels or compartments in respect to the present invention are spaces in which the fluids, which are used in the device, system or method according to the present invention, are confined to a certain area. The geometry of such channels or compartments can adopt any suitable form, such as for instance circular or rectangular areas in which samples are collected for further processing and linear channels connecting the aforementioned areas. The channels may be grafted into the substrate material by various methods known to the skilled person, such as etching, milling, embossing, molding, printing, and the like.

Alternatively, the channels can be present in the form of "virtual channels" or also "virtual compartments". Such virtual channels comprise areas with surface properties which differ from the surrounding surface of the substrate in such a way that the fluids essential remain confined within the channels. For example, such virtual channels can be produced from glass surfaced which are functionalized with a hydrophobic layer of octadecyltrichlorosilane or other silanes, or hydrocarbons, which may be partially fluorinated or perfluorinated. These layers can then for instance be etched with a mask in order to obtain virtual channels. Virtual channels are ideally suited for combination with electro-wetting technology. A further advantage of the virtual channel technology is that it is enabled for large-area processing and subsequent dicing to yield a low-cost production process of devices according to the present invention.

The choice of substrate materials for the production of devices or systems according to the present invention is not particularly limited. However, such substrate materials will have to be functional under the conditions used in the applications according to the present invention. Examples for such substrate materials are organic and inorganic materials, chemically and biologically stable materials, such as glass, ceramics, plastics, such as polyethylene, polycarbonate, polypropylene, PET, and the like. The substrates may contain additional features and materials, such as optical features (e.g. windows for optical read-out), magnetic features (e.g. materials to enhance the actuation of the magnetic particles), electrical features (e.g. current wires for sensing, actuation and/or control), thermal features (e.g. for thermal control), mechanical features (e.g. for cartridge stability), identification features, etc.

The co-transported material which may be a target and/or a further material (e.g. a reporter group) may be attached to a magnetic particle by chemical or physical means, such as covalent bonding, van-der-Waals interactions, ionic interactions, hydrophobic interactions, hydrogen bonding, complexation, and the like. Chemical linkers for covalent bonding may be, but are not limited to nucleic acids, peptides, carbohydrates, hydrocarbons, PEG, which may be attached with various chemical strategies, such as amide linkage, dithiol linkage, ester linkage or click chemistry. Examples for biomolecular attachment strategies may be selected from, but are not limited to antibodies, protein-protein interactions, protein-nucleic acid interactions, interactions between molecules and/or cell fractions and/or whole cells. Depending on the type of extraction desired, surface chemistries and surface-bound biochemical moieties may be selected for non-specific as well as for specific binding of targets or classes of targets to the magnetic particles. A skilled person will be able to select one of these well-known methods which is suitable for the target. An example of a specific biomolecular attachment method is to bind nucleic acids, e.g. obtained by PCR, to the magnetic particles by hybridization with complementary oligonucleotides. These oligonucleotides may be complementary to a specific sequence found on the PCR primers so that only amplified nucleic acids are captured.

The target herein can be any chemical or biological entity which is suitable for the attachment to the magnetic particles. Hence, the target can be a molecule, such as a small organic molecule, a drug, a hormone, a polypeptide, a protein, an antibody, a polynucleic acid, carbohydrates, or also a chemical reagent. The target can also be a larger biological entity, such as a micro-organism, an animal cell or a human cell, as for example blood cells, tissue cells or cancer cells, a plant cell, a bacterial cell, a fungal cell, a virus or fragments or parts of the aforementioned, such as fragments of bacterial cell walls, virus-like particles, fragments of viral capsids and the like.

A sample or sample fluid specifies a fluid which comprises a target, the latter of which is further discussed herein. Said sample or sample fluid may be used in accordance with the present invention as is, or may be derived from a prior sample and may optionally have been pretreated. Accordingly, if a sample is fractioned prior to or during the use in accordance with the present invention by any method known to the skilled person into one or more parts of said sample, the fluids resulting thereof will furthermore be referred to as samples or sample fluids, regardless whether they comprise the same substances as the original sample or only parts thereof.

Pretreatment techniques are known to the skilled person and are not limited to specific techniques. Examples of pretreatment techniques are for instance, heating, lysis, fractionation (e.g. by centrifugation, filtration, decanting, chromatography and the like), concentration, modification with biological and/or chemical reagents.

A sample fluid may comprise dissolved, solubilized or dispersed solids or solid like corpuscles, such as for examples cells.

A sample or sample fluid as described above may be obtained from various sources, which are not particularly limited. Examples of such sources are, but are not limited to samples of biological origin, which may preferably be patient-derived samples, more preferably point-of-care samples, samples from food, industrial, clinical and environmental testing.

Samples of biological origin which can be utilized in the current invention are not particularly limited. Some of the possible examples for sources of such samples are bodily fluids, such as blood or lymphatic fluids, saliva, sputum, faeces, expulsions, sweat, skin secretions, homogenized tissue samples, bacterial samples which may originate from laboratory culture or from a natural source, such as environmental samples. Samples of biological origin also encompass samples obtained from in vitro processes and biological material which may have been altered (e.g. mutated, functionalized, etc.) in an in vitro process. Examples of such processes are, but are not limited to nucleic acid amplification, pretreated or untreated cell lysates, protein purification, chemical and/or biochemical functionalization of proteins, (e.g. such as phosphorylation, glycosylation, etc.), purification methods, such as FPLC, PAGE, ultracentrifugation, capillary electrophoresis and the like.

The magnetic particles (MP's) used in the method, system or device according to the present invention can be used as carriers for the targets. Detection of the target, which may be cleaved prior to detection or remain attached to the MP, can be done by standard methods known to the skilled person. Alternatively, a reporter molecule may additionally be attached to the MP, which can selectively be treated or cleaved whereby the sample remains attached to the MP or which is detected while remaining attached to the MP, can be used for detection by standard methods known to the skilled person.

Detection can be based on the specific properties of the magnetic particles themselves, on the target or on reporter groups attached to the particles or the targets by the above-mentioned means of attachment. For example, the detection techniques may be based on, but are not limited to colorimetry, luminescence, fluorescence, time-resolved fluorescence, photothermal interference contrast, Rayleigh scattering, Raman scattering, surface plasmon resonance, change of mass (e.g. by MALDI), quartz crystal microbalances, cantilevers, differential pulse voltametry, chemical cartography by non linear generation frequency spectroscopy, optical change, resistivity, capacitance, anisotropy, refractive index and/or counting of nanoparticles, methods which are based on transmission, refraction or absorption of electromagnetic radiation, such as visible, IR- or UV-light, NMR, ESR. Detection may be based on methods which directly measure the presence of the magnetic particles or the target attached thereto or released therefrom. Detection may also based on indirect methods, which rely on the accumulation, release or modification of one or more secondary reporter molecules, such as FRET, ELISA, PCR, real-time PCR, hybridization-based methods and the like. For instance, detection of nucleic acids obtained by PCR, can be based on PCR primers or dNTPs which are labelled with a reporter group, so that only amplified nucleic acids are detected.

Specific examples of modified magnetic particles are: Strept-MP: Magnetic particles can be coated with a biologically-active layer in order to bind to other substances. For example, magnetic particles can be coated with streptavidin in order to specifically bind to biotin or biological moieties tagged with biotin. Immuno-MP: Magnetic particles can be coated with a biologically-active layer in order to bind to other substances. For example, magnetic particles can be coated with antibodies in order to specifically bind to antigens or biolotical moieties tagged with antigens. Oligo-FITC: Tagged primers can be used during amplification in order to build tags into the product. For example, an FITC tag can be built into an oligonucleic amplification product, which facilitates further handling and detection using anti-FITC antibodies. Note that modified magnetic particles are by no means limited to the above-mentioned Examples.

Alternatively, the magnetic particles themselves can also be utilized for detection purposes. In this case, the sensor for detecting the particles can be any suitable sensor to detect the presence of magnetic particles on or close to a sensor surface. Detection can be based on any property of the particles, e.g. via magnetic methods (e.g. magnetoresistive, Hall, coils), optical methods (e.g. imaging, fluorescence, chemiluminescence, absorption, scattering, evanescent field techniques, surface plasmon resonance, Raman spectroscopy, etc.), sonic detection (e.g. surface acoustic wave, bulk acoustic wave, cantilever, quartz crystal etc), electrical detection (e.g. conduction, impedance, amperometric, redox cycling), combinations thereof, etc. For use in some of the above-mentioned methods, the magnetic particles must be equipped with further functional entities, such as for example a fluorescent dye. Such modified particles are commercially available or in some cases the particles will have to be modified prior to the use in the present invention. A skilled person will know how to select the necessary modification which is suitable for the desired method of detection.

The magnetic particles used in the method, system or device according to the present invention can be in the dimension ranging between 3 nm and 10000 nm, preferably between 10 nm and 5000 nm, more preferred between 50 nm and 3000 nm.

An electromagnet, as used in the method, the device or the system according to the present invention, can also be a multipole magnet. The currents through the multipole magnet coils can be controlled in such a way that a linear phase-step motor is implemented to drag the beads over long distances over each of the multiple valve-like structures. In this way no mechanically moving parts are needed in the read-out device. Ideally, the staged valve-like structure geometry may be synchronized with the multi-pole electromagnet geometry.

The detection by the detection methods mentioned herein can occur with or without scanning of the sensor element with respect to the biosensor surface. Measurement data can be derived as an end-point measurement, as well as by recording signals kinetically or intermittently.

The target or a label for detection can be detected directly by the sensing method. Alternatively, the particles, the target or the label can be further processed prior to detection. An example of further processing is that materials of interest are added or that the (bio)chemical or physical properties of the target or the label are modified to facilitate detection.

The device, system or method according to the present invention comprises at least two compartments separated by a valve-like structure. Notwithstanding, a device, system or method according to the present invention may comprise more than two compartments, which may be connected by channels in order to obtain a serial or parallel arrangement of compartments, whereby at least two distinct areas are defined by separation from one another by a valve-like structure. However, not all compartments necessarily have to be separated from each of the adjacent compartments by valve-like structures (e.g. compare FIG. 5*b* in which the valve-like structures separating the sub-compartments from compartments 2 and 3 are optional).

In a preferred embodiment compartments that are separated by the valve-like structure are in close proximity. One advantage of the close proximity of the two chambers is that the magnetic particles are efficiently transported across the hydrophobic valve. We attribute the efficient transport (i) to the short inter-fluid distance that needs to be crossed and (ii) to the interfacial energy that is released when the front of the magnetic particle body touches the second fluid. The touching of the magnetic particle body with the second fluid causes the meniscus at the front of the magnetic particle body to disappear. As a result, the magnetic particles can efficiently move into the second fluid.

The valve-like structure in one embodiment comprises a hydrophobic barrier. This barrier is preferably embodied in a channel of which at least two surfaces are essentially hydrophobic. It is most preferred that two oppositely positioned surfaces are hydrophobic. Even more preferred, the entire channel is hydrophobic. In case of a circular channel, where it is difficult to identify separate surfaces, it is preferred that at least 50% of the channel surface is hydrophobic and this is preferably distributed such that two opposite quadrants of the channel surface are hydrophobic. We have surprisingly found that channels wherein at least two surfaces are hydrophobic, perform significantly better in transport of particles than channels with one hydrophic and one hydrohilic surface. Especially the balance of the pinch off is improved in these channels. In particular, it appeared that the meniscus of fluid closes tightly around the back of the magnetic particle body. The pinch-off occurs shortly after the magnetic particle body has merged with the second fluid. The tight closure of meniscus around the back of the magnetic particle body is believed to ensure a very small carry-over of first fluid into the second fluid.

This merging-induced pinch-off combines two important properties: (i) the transport of magnetic particles toward the second fluid is enhanced upon merging because the interfacial energy associated with the front of the magnetic-particle body is released, and (ii) the meniscus pinches-off tightly behind the magnetic particle body, which gives low cross contamination.

The compartments may independently be equipped with additional sub-compartments in which magnetic particles can be stored in order to add magnetic particles to or remove magnetic particles from the sample. Furthermore the compartments may independently be equipped with specific additional features, such as surfaces which are modified, e.g. with antibodies in order to allow ELISA-type assays, in the form of arrays for nucleic acids, with capture molecules. Also the compartments may have features for the addition of compartment-specific reagents, in dry or in wet form, in order to facilitate the (bio)chemical process in the compartment. Furthermore, the device or system may be wholly or partially comprised of a material which is adapted to the use with the detection or processing techniques described herein. Hence, such a material may for instance be heat resistant (e.g. for PCR) or translucent (e.g. for spectroscopy).

In the method, system or device according to the present invention, one or more types of magnetic particles may be used which may independently differ in the material of which they are composed and/or which may independently be modified with surface molecules in order to be compatible with the respective targets and the detection and processing techniques mentioned herein.

In the pretreatment, detection and processing techniques mentioned herein (e.g. PCR, ELISA, FRET, spectroscopic methods and further methods mentioned herein), additional components, such as buffers, solvents, additives and reagents may be used which are routinely used with these techniques and which are known to the skilled person.

The device, system or method according to the present invention can be used with several biochemical assay types, e.g. binding/unbinding assay, sandwich assay, competition assay, displacement assay, enzymatic assay, etc. The system or device according to the present invention can detect molecular biological targets. Note that molecular targets often determine the concentration and/or presence of larger moieties, e.g. cells, viruses, or fractions of cells or viruses, tissue extract, etc.

The method, system or device according to the present invention are suited for sensor multiplexing (i.e. the parallel use of different sensors and sensor surfaces), label multiplexing (i.e. the parallel use of different types of labels) and compartment multiplexing (i.e. the parallel use of different reaction compartments).

The system or device according to the present invention can be used as rapid, robust, and easy to use point-of-care biosensors. The system or device according to the present invention can be in the form of a disposable item to be used with a compact reader instrument, containing the one or more magnetic field generating means for manipulation of magnetic particles and/or one or more detection means. The means for manipulation and/or detection may also be provided by an external device. Also, the device, methods and systems of the present invention can be used in automated high-throughput testing. In this case, the device with reaction compartments should have a shape that fits into an automated instrument, e.g. a shape similar to a well-plate device or a cuvette device. The device or system according to the present invention can accordingly also be provided in the form of a ready-to-use system, similar to a kit, in which the necessary (buffer) reagents and magnetic particles are incorporated in a dry and/or a wet form.

Apart from analytical applications, the method, system or device according to the present invention can be used in a lab-on-a-chip system or process-on-a-chip system for synthesis purposes. Molecules and types of reactions are not particularly limited, as long as the reactive groups of the molecules and the reaction conditions are suitable for a lab-on-a-chip or process-on-a-chip system. A skilled person will be able to decide which conditions are compatible with lab-on-a-chip or process-on-a-chip devices and in particular with the valve-like structures according to the present invention in such a way, that no reaction occurs between the reactive groups and the valve-like structure according to the present invention. Some of the examples of such syntheses may be polynucleotide synthesis, polypeptide synthesis, ligation chemistry, click chemistry or other chemical modifications which can generally be executed in a lab-on-a-chip or process-on-a-chip device.

Further applications include DNA analysis (e.g., by PCR and high-throughput sequencing), point-of-care diagnosis of diseases, proteomics, blood-cell-separation equipment, biochemical assays, genetic analysis, drug screening and the like.

EXAMPLES

Production of a Device or System According to the Present Invention:

Example 1

A micro fluidic device was made from glass substrates covered with a monolayer of octadecyltrichlorosilane or other silanes. A mask was covered onto the surface of both substrates and exposed to atmospheric plasma. A mirrored mask layout was used for the two substrates. The local hydrophilisation leads to 'virtual channels' in between the glass plates. The two glass substrates were assembled together with double sided tape acting as a spacer layer for the two glass substrate. The tape also acts as a liquid sealing to the outside worlds such that a moist-saturated environment is achieved for the virtual channels. This prevents the fluids from further evaporation from the virtual channels. Once assembled an aqueous based dispersion of magnetic beads was introduced into the channel.

Physical channels and compartments for fluids may be produced by a wide range of fabrication techniques, including patterning and joining techniques, such as embossing, molding, milling, etching, printing, sealing, welding, gluing, etc.

Examples for Applications of the Present Invention

Example 2

Two Compartment Microfluidic System

The fluid is a blood sample. In pretreatment unit 9 the sample is e.g. filtered, buffer salts and other reagents are added, preferably from a dry reagent. In pretreatment unit 5 magnetic particles are added, which are incubated with the sample in compartment 1. In pretreatment unit 7 further pretreatment takes place, e.g. filtering of the sample. This fluid is transported to compartment 2, e.g. by capillary transport. Magnetic particles are transported through barrier channel 3. These can further react in compartment 2, e.g. for detection or further processing.

Several timing sequences are possible. In the above-described, compartment 2 was first filled with fluid and thereafter magnetic particles were transported into compartment 2. In is also possible that magnetic particles are first moved to compartment 2 and thereafter fluid is supplied to compartment 2.

Example 3

Three Compartment Microfluidic System

An Example of a Three-Compartment Assay is the Following (MP Herein Means "Magnetic Particle"):

Immuno-MPs are added to the sample. In the first compartment, the immuno-MPs catch cells or other moieties, e.g. viruses. Thereafter the MPs are transported to the second compartment through a valve-like structure. This represents an extraction and up-concentration step. Cells are then lysed in the second compartment. Thereafter probe molecules attach to targets in the lysate. E.g. oligo-biotin and oligo-FITC bind specifically to released RNA. Thereafter the immuno-MPs are pulled out of the second compartment into a first sub-compartment, and strept-MPs are released into the second compartment from a second sub-compartment. The second sub-compartment may be connected to the second compartment by a valve-like structure. In the second compartment, the strept-MPs bind to the biotinylated probes. Thereafter the strept-MPs are transported to the third compartment through a valve-like structure. The third compartment is equipped with a sensor with anti-FITC antibodies. Optionally (dry) reagents are also present in the third compartment in order to enhance the binding and sensing processes.

Example 4

Four Compartment Microfluidic System

In the first compartment, a reagent with immuno-MP1 is added to the sample. The capture molecules on MP1 are coupled via a cleavable linker The MP1's capture cells or other moieties, e.g. viruses. Thereafter the MP1's are transported to the next compartment through a valve-like structure. This constitutes a first up-concentration step, in which the volume is e.g. reduced from 1 ml to 50 μl. In the second compartment, an enzyme cleaves the cells from the MP1's. The MP1 are removed from the compartment into a sub-compartment. Thereafter, immuno-MP2's are supplied from another sub-compartment, whereby these MP2's do not have a cleavable linker. The MP2's catch the cells. Thereafter the MP2's are transported to the next compartment through a valve-like structure, which represents a second up-concentration step, e.g. reducing the volume from 50 μl to 2 μl. In the third compartment, the cells are lysed. Thereafter probe molecules attach to targets in the lysate. E.g. oligo-biotin and oligo-FITC bind specifically to released RNA. Thereafter the immuno-MPs are pulled out of the compartment into a sub-compartment, and strept-MPs are released into the third compartment from another sub-compartment. These bind to the biotinylated probes. Thereafter the strept-MPs are transported to the fourth compartment through a valve-like structure. In the fourth compartment sensing is performed using anti-FITC antibodies.

Example 5

Microfluidic Device with Washing Channels

Figure 4A:
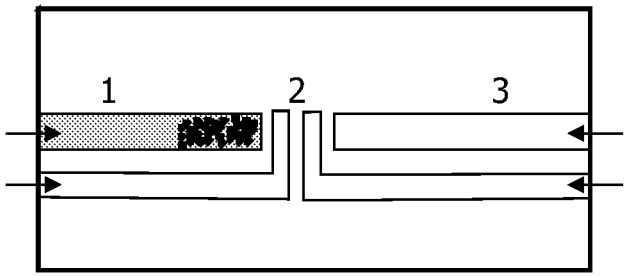
FIG. 4 Schematic representation of a planar microfluidic device without physical channels containing wash areas. Arrows represent parts of the channels from which solvents can be introduced into or removed from the channels. Virtual channels and wash areas are formed by local hydrophilisation of both glass substrates. One virtual channel (1) is filled with magnetic particles dispersed in a fluid, the other channel (3) and the wash areas (2) are filled with a washing fluid. The magnetic beads are dragged from one channel over the sequentially installed valve-like structures (in this case hydrophobic barriers) and through the wash areas, into the next channel; the co-migrating solvent is diluted in each wash area (2).
Figure 4B:
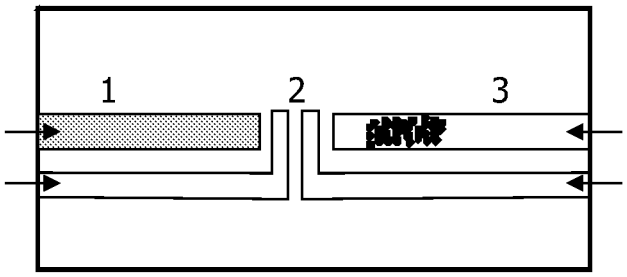

A planar micro fluidic device without physical channels containing wash areas was manufactured, as outlined in FIG. 4. Virtual channels and wash areas were formed by local hydrophilisation of both glass substrates. One virtual channel (1) was filled with magnetic particles and a colored fluid (Orange II sodium salt II in water), the other channel (3) and the wash areas (2) were filled with water. The magnetic beads were dragged with a permanent magnet from one channel (1) over the hydrophobic barriers and through the wash areas (2), into the next channel (3); the co-migrating solvent was diluted in each wash area, which could be seen in the decreasing concentrations Orange II after each passing over a hydrophobic barrier.

Example 6

Microfluidic Device for Integrated Nucleic Acid Testing

Figure 5A:
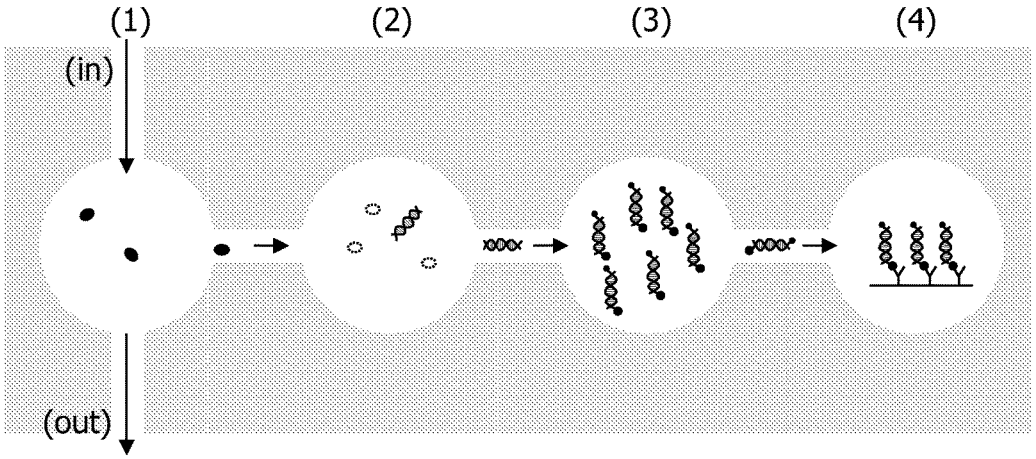
FIG. 5 Schematic representation of a micro fluidic device for integrated nucleic acid testing a) without valve-like structures and b) with valve-like structures.
Figure 5B:
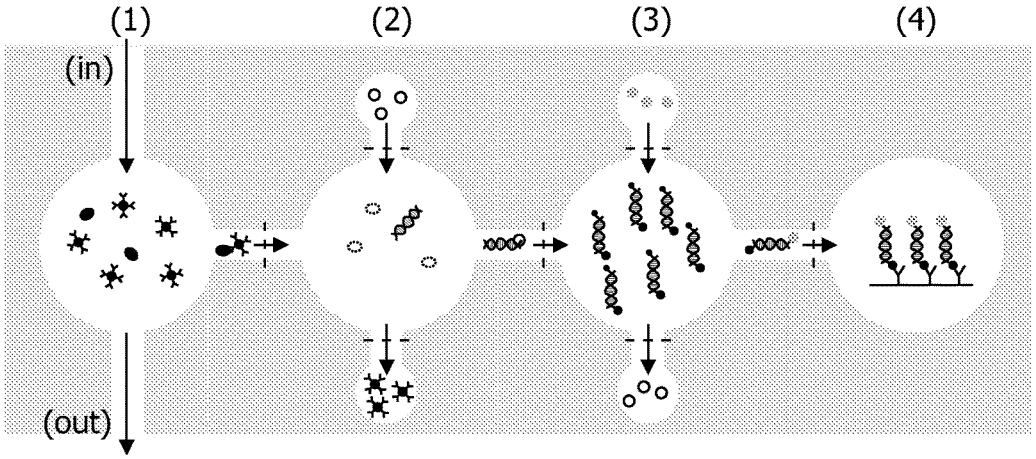

A device which is represented by FIG. 5 *b*) or a similar setup can be used for integrated nucleic acid testing. A sample is introduced through the inlet (in). Cells are captured and transported from compartment (1) to (2) using magnetic particles comprising capture molecules (e.g. antibodies) which are specific for the cells of interest. Optionally the supernatant can be removed via the outlet (out). In compartment (2), the cells are lysed, and the first magnetic particles are removed into a separate storage compartment. Subsequently, a second batch of magnetic particles that recognize nucleic acids or a class of nucleic acid materials is added from a further storage compartment. The nucleic acids are then co-transported with the magnetic particles into compartment (3), where the nucleic acid material may be released from the magnetic particles, where the second magnetic particles may be removed into a storage compartment, and where subsequently nucleic acids are amplified (e.g. by PCR). A third species of magnetic particles, comprising capture molecules that recognize only amplified nucleic acids, is then used to co-transport amplified nucleic acids into compartment (4), where amplified nucleic acids are detected.

Example 7

Hydrophic Channel Between Two Compartments with Two Hydrophobic Surfaces

Experiments have been done with two kinds of devices: device 7.1 with two hydrophobic surfaces present in a channel that connected two compartments and device 7.2 containing two compartments connected with a channel with one hydrophobic and one slightly hydrophilic surface.

The bottom part of both devices is a microscope glass slide on which a self-assembled monolayer (SAM) of perfluorodecyl-tri-ethoxysilane is applied. This SAM is partly removed by oxygen plasma treatment, leaving a pattern of hydrophilic chambers as islands in a hydrophobic background. For device 7.1, the top part is a slide of PMMA that has been dipcoated in Telfon™ AF 1600. For device 7.2, the top part is an untreated slide of PMMA. In both devices, the top part is separated from the bottom part by 100 μm thick double-sided tape.

The fluor-rich SAM has a contact angle of about 105°. Untreated PMMA has a contact angle of about 75°, whereas PMMA dipcoated in Teflont AF 1600 has a contact angle of about 115°.

The general procedure as described in the earlier examples was used.

After the merging of magnetic particles with the second fluid, the fluid connection was pinched-off in the device with two hydrophobic surfaces (7.1) and not in the device with one hydrophobic and one hydrophilic surface (7.2). It can therefore be concluded that the hydrophobicity of both top and bottom part is preferential for good pinch-off.

The invention claimed is:

1. A device for transferring magnetic particles in a fluidic sample, the device comprising:

first and second substrates forming, therebetween, two compartments and a channel interconnecting the two compartments; and a valve-like structure that allows passage of the magnetic particles through the channel between the two compartments upon application of a magnetic force to the magnetic particles, wherein the valve-like structure comprises a hydrophobic barrier formed by a silane hydrophobic surface in the channel that prevents a fluid disposed in one of the two compartments from migrating to the other of the two compartments in the absence of a magnetic force acting upon the magnetic particles.

2. The device according to claim 1, wherein the magnetic force causes the magnetic particles to pass through from a first side of the hydrophobic barrier through to an opposing side of the hydrophobic barrier.

3. The device according to claim 2, wherein the channel is a capillary channel.

4. The device according to claim 1, wherein the compartments are in close proximity.

5. The device according to claim 1, further comprising a magnetic source that is an electromagnet, an integrated current wire, a permanent magnet and a mechanically moving permanent magnet, or an electromagnet.

6. The device according to claim 1, wherein:

the hydrophobic surfaces comprise opposed hydrophobic surfaces that provide the channel therebetween, and the magnetic particles travel through the channel during the passage between the two compartments.

7. A device for transferring magnetic particles in a fluidic sample, the device comprising:

first and second substrates situated apart from each other and mirroring each other to form two compartments and a channel interconnecting the two compartments, one of the two compartments is configured to include the magnetic particles, and a valve-like structure that allows passage of the magnetic particles through the channel between the two compartments upon application of a magnetic force to the magnetic particles, wherein the valve-like structure comprises a hydrophobic barrier formed by a silane hydrophobic surface in the channel that prevents a fluid disposed in the one compartment from migrating to the other of the two compartments in the absence of the magnetic force acting upon the magnetic particles.

8. The device of claim 1, wherein 50% or more of the channel comprises the hydrophobic surface.

9. The device of claim 1, further comprising:

another valve-like structure comprising a silane hydrophobic barrier formed by a silane hydrophobic surface in another channel, wherein:

the first and second substrates form a third compartment that is interconnected to a first of the two compartments through the other channel, the valve-like structure prevents a first fluid disposed in a second of the two compartments from migrating to the first compartment in the absence of the magnetic force acting upon the magnetic particles, and the other valve-like structure prevents a second fluid disposed in the third compartment from migrating to the first compartment in the absence of another magnetic force acting upon other magnetic particles disposed within the third compartment.

10. The device of claim 1, further comprising:

another valve-like structure comprising a silane hydrophobic barrier formed by a silane hydrophobic surface in another channel, wherein:

the first and second substrates form a third compartment that is interconnected to a first of the two compartments through the other channel, the valve-like structure prevents a first fluid disposed in a second of the two compartments from migrating to the first compartment in the absence of the magnetic force acting upon the magnetic particles, and the other valve-like structure prevents a second fluid disposed in the first compartment from migrating to the third compartment in the absence of another magnetic force acting upon other magnetic particles disposed within the first compartment.

11. The device of claim 10, further comprising:

a third valve-like structure comprising a silane hydrophobic barrier formed by a silane hydrophobic surface in a third channel, wherein:

the first and second substrates form a fourth compartment that is interconnected to the first compartment through the third channel, and the third valve-like structure prevents a third fluid disposed in the first compartment from migrating to the fourth compartment in the absence of a third magnetic force acting upon third magnetic particles disposed within the first compartment.

* * * * *